US005607352A

United States Patent [19]

Tani

[11] Patent Number: 5,607,352

[45] Date of Patent: Mar. 4, 1997

[54] COIN DISPENSING APPARATUS

[75] Inventor: Kiyoshi Tani, Saitama, Japan

[73] Assignee: Asahi Seiko Kabushiki Kaisha, Tokyo, Japan

[21] Appl. No.: 633,001

[22] Filed: Apr. 16, 1996

Related U.S. Application Data

[63] Continuation of Ser. No. 488,956, Jun. 7, 1995, abandoned, which is a continuation of Ser. No. 144,350, Nov. 1, 1993, abandoned.

[30] Foreign Application Priority Data

Nov. 2, 1992 [JP] Japan ..... 4-336538

[51] Int. Cl.[6] ..... G07D 1/00

[52] U.S. Cl. ..... 453/57; 221/234

[58] Field of Search ..... 432/32, 33, 34, 432/49, 57; 221/233, 234

[56] References Cited

U.S. PATENT DOCUMENTS

| | | | |
|---|---|---|---|
| 902,067 | 10/1908 | Froberg | 453/34 |
| 3,818,918 | 6/1974 | Nissmo et al. . | |
| 4,010,766 | 3/1977 | Bowles et al. . | |
| 4,752,274 | 6/1988 | Abe | 453/57 X |
| 5,074,434 | 12/1991 | Maki | 221/265 |

FOREIGN PATENT DOCUMENTS

| | | | |
|---|---|---|---|
| 2200692 | 3/1994 | Australia . | |
| 204405 | 12/1986 | European Pat. Off. . | |
| 3-158988 | 7/1991 | Japan | 453/57 |

*Primary Examiner*—F. J. Bartuska
*Attorney, Agent, or Firm*—Sughrue, Mion, Zinn, Macpeak & Seas

[57] ABSTRACT

A coin dispensing apparatus able to dispense coins until and including the last coin left in the apparatus that satisfies the need for downsizing. The coin dispensing apparatus has a coin dispensing disc in the form of a rotary disc supported for rotation by a drive shaft in opposition to a substrate. A cylindrical case surrounds the coin dispensing disc and an outlet slot is formed in the cylindrical case. Guide apertures are formed circumferentially at equal intervals in a coin transporting disc that guide coins on the substrate. A pushing pin is positioned between the substrate and coin transporting disc for pushing coins towards the cylindrical case as the coin transporting disc is rotated. A guide groove in the disc guides the pushing pin in a direction toward the outlet slot.

13 Claims, 8 Drawing Sheets

COIN DISPENSING APPARATUS

This is a continuation of application Ser. No. 08/488,956 filed on Jun. 7, 1995 now abandoned, which is a continuation of parent application Ser. No. 08/144,350 filed on Nov. 1, 1993, now abandoned.

BACKGROUND OF THE INVENTION

1. Field of the Invention

The present invention relates to a coin dispensing apparatus that contains coins or tokens in bulk in a hopper and dispenses the coins one at a time from inside the hopper as necessary.

2. Background of the Prior Art

An example of a conventional coin dispensing apparatus is disclosed in Japanese Patent Laid-Open Publication No. 51-119295 which was filed by the applicant of the present application.

As shown in FIGS. 7 and 8, this conventional coin dispensing apparatus comprises a substrate 2 which arranged at a position inside hopper 1, and is inclined towards horizontal. A coin transporting rotary disc 4 is provided in the form of a rotary disc which is supported rotatably by drive shaft 3 and is spaced in opposition to substrate 2 with a clearance slightly larger than the thickness of coins (not shown). A cylindrical case 5 in the form of an enclosure wall extends towards coin transporting rotary disc 4 from substrate 2 and surrounds coin transporting rotary disc 4, and outlet slot 6 being formed in cylindrical case 5. Four guide apertures 7 are equally and circumferentially spaced in coin transporting rotary disc 4 that guide coins on substrate 2. Each aperture 7 has transporting arms 8 that are mounted on the substrate side of the coin transporting rotary disc 4 and extend along the radial direction to a hypothetical circle that passes through the centers of guide apertures 7 having the center of coin transporting rotary disc 4 as its axis and slide coins in the direction of rotation of coin transporting rotary disc 4 (direction indicated by the arrow in the drawings). A regulating pin 9 is retractably arranged on substrate 2 at a position facing outlet slot 6 that changes the direction of coins dispensed by transporting arms 8 towards outlet slot 6 to dispense coins from outlet slot 6. Finally, reference numeral 12 indicates a drive motor that rotates drive shaft 3.

However, in the conventional coin dispensing apparatus described above, transporting arms 8 slide coins only in the direction of rotation of coin transporting rotary disc 4 on substrate 2, and regulating pin 9 dispenses coins from outlet slot 6 by changing the direction of coins dispensed by transporting arms 8 towards outlet slot 6. As a result, since coins, the direction of which has been changed by regulating pin 9, leave a course on which they can be pushed by transporting arms 8, the coins in front are not dispensed from outlet slot 6 unless they are pushed by other succeeding coins.

Namely, in the conventional coin dispensing apparatus, when there is only one coin remaining in the apparatus to be dispensed, since there are no other succeeding coins behind it, that last coin cannot be dispensed outside the apparatus.

On the other hand, as shown in FIG. 9, in a coin dispensing apparatus disclosed in Japanese Patent Laid-Open Publication No. 61-281385 also filed by the applicant of the present application, scraper 11 is provided that rotates in synchronization with coin transporting disc 4. Scraper 11 has guide apertures 7 and an equal number of radial transporting blades 10. The ends of transporting blades 10 protrude through an opening continuous with outlet slot 6 and between substrate 2 and coin transporting disc 4. The transporting blades 10 scrape the coins in concert with transporting arms 8 and regulating pin 9 in dispensing the coins. As a result, transporting blades 10 of scraper 11 were able to scrape out even the last coin left in the apparatus.

However, since the conventional coin dispensing apparatus as described above requires a scraper, there are disadvantages. Specifically, the number of parts is increased and the overall size of the device is forced to be larger, thus having the additional shortcoming of being contrary to the need for downsizing.

SUMMARY OF THE INVENTION

In consideration of the above-mentioned problems, a first technical object of the present invention is to provide a coin dispensing apparatus able to dispense coins including the last coin left in the apparatus.

In addition, a second technical object of the present invention is to provide a coin dispensing apparatus that satisfies the need for downsizing.

According to the present invention, a coin dispensing apparatus has a rotary disc with a plurality of coin guiding apertures therein which is rotatable with respect to a substrate at a clearance essentially corresponding to the thickness of dispensable coins and to convey the coins to an outlet. A pushing member is positioned between the substrate and said rotary disc and is guided by tracks on at least one of the disc and substrate so that it pushes out said coins towards said outlet slot in correspondence with rotation of the rotary disc. Preferably the tracks are disposed on both the disc and substrate.

In addition, according to the present invention, there is a track on the rotary disc that extends substantially in a radial direction of the rotary disc and holds one end of a corresponding pushing member.

In addition, according to the present invention, the track on the substrate side of the rotary disc either extends through the disc or extends into the disc and has a concave-shaped cross-section.

In addition, according to the present invention, there is a track on the substrate that defines a closed path for holding another end of plural pushing members.

In addition, according to the present invention, the pushing member has a rib with a diameter that extends to the outer edges of the guide apertures.

In addition, according to the present invention, there is a direction changing member provided on the substrate at a position facing the outlet slot, wherein the direction changing member makes contact with coins pushed out by the pushing member to change their direction so that the coins are pressed out towards the outlet slot.

In addition, according to the present invention, the direction changing member is retractably arranged with respect to the substrate.

In addition, according to the present invention, there is a rotatable outlet roller provided on the outlet slot, wherein the outlet roller makes contact with coins pushed out by the pushing member to dispense them outside.

In addition, according to the present invention, the outlet roller is arranged to be able to approach and move away from the outlet slot.

In addition, according to the present invention, the closed path comprises a pushing path, a return path continuous with said pushing path and an inner circumferential path continuous with said return path, said pushing path extends from a first pre-determined position on said substrate to said outlet slot, said return path extends from said outlet slot to a pre-determined second position on said substrate, and said inner circumferential path extends from said second position to said first position and is provided concentrically to said rotary disc having the center of said rotary disc as its axis.

In addition, according to the present invention, the inner circumferential path is provided on the inside of a circle that passes through the centers of the plural guide apertures having the center of the rotary disc as its axis, and the pushing member forces coins towards an enclosure wall by being guided along the inner circumferential path.

In addition, according to the present invention, the inner circumferential path is provided on the outside of a circle passing through the centers of the guide apertures having the center of said rotary disc as its axis, and the pushing member has transporting arms that slide coins in the rotating direction of the rotary disc on the substrate, and pushing pins that push out coins along the inner circumferential path by forcing the coins towards the pushing member.

BRIEF DESCRIPTION OF THE DRAWINGS

FIG. 5*a* is a perspective view showing a coin dispensing disc and sliding portion in the preferred embodiment shown in FIG. 1, while

FIG. 6*a* is a perspective view of a cylindrical case in the preferred embodiment shown in FIG. 1, while

DESCRIPTION OF THE PREFERRED EMBODIMENTS

Figure 1:
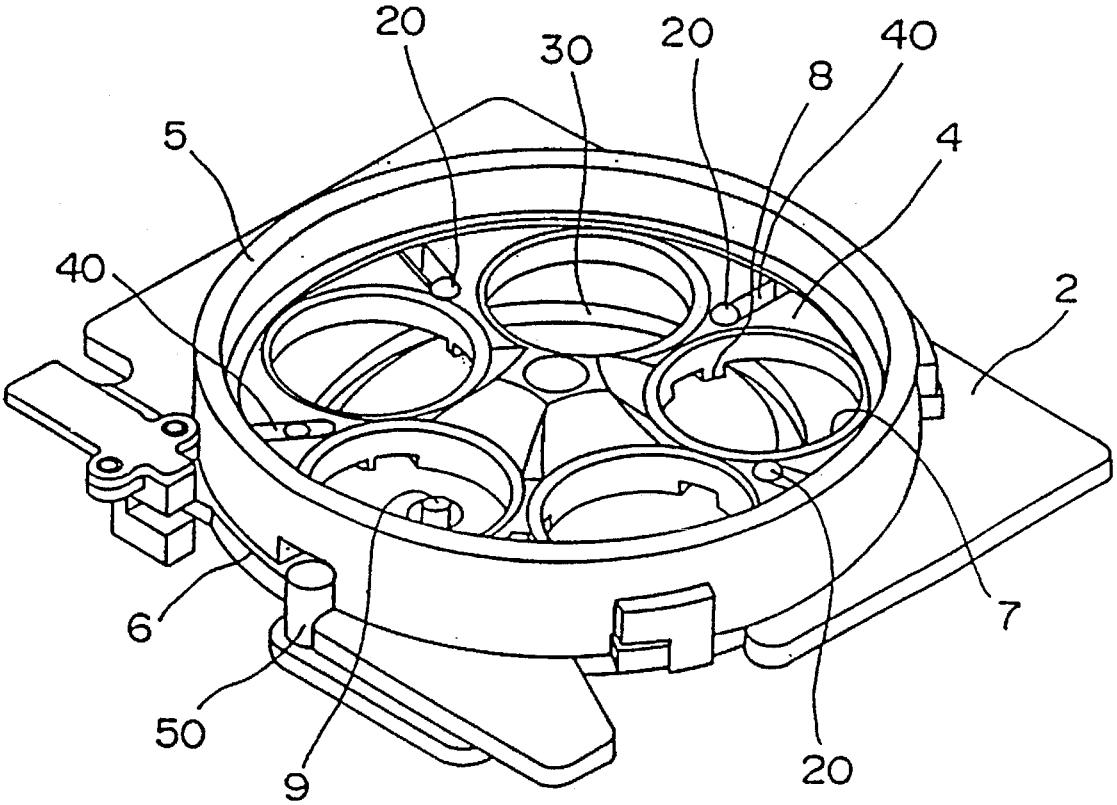
FIG. 1 is a perspective view showing the coin dispensing apparatus claimed in a preferred embodiment of the present invention.

The following provides an explanation of the preferred embodiments of the present invention with reference to the drawings. Furthermore, an explanation of those reference numerals that are the same as reference numerals shown in the conventional coin dispensing apparatus is omitted.

As shown in FIG. 1, a preferred embodiment of the coin dispensing apparatus of the present invention has substrate 2 arranged at a position either horizontal or inclined to horizontal. A coin transporting disc 4 in the form of a rotary disc is supported for rotation by drive shaft 3 in opposition to substrate 2 at a clearance that is slightly larger than the thickness of the coins (not shown). A cylindrical case 5 in the form of an enclosure wall extends from substrate 2 towards coin transporting disc 4 and surrounds coin transporting disc 4, an outlet slot 6 is formed in cylindrical case 5. Five guide receptacles 7 are formed circumferentially at equal intervals in coin transporting disc 4 and guide coins on substrate 2. A transporting arm 8 extends along the radial direction to a hypothetical circle passing through the centers of guide receptacles 7, having the center of coin transporting disc 4 as its axis, and slides coins in the direction of the direction of rotation of coin transporting disc 4 (direction shown by arrow in the drawing) on substrate 2. Regulating pin 9 is retractably arranged on substrate 2 at a position facing outlet slot 6 and dispenses coins from outlet slot 6 by changing the direction of coins carried by transporting arm 8 towards outlet slot 6. Guide apertures 7 may be have notched shapes opening towards the circumference of coin transporting disc 4.

In the preferred embodiment, a pushing pin 20 is positioned between substrate 2 and coin transporting disc 4 and is operative to push coins towards cylindrical case 5 accompanying rotation of coin transporting disc 4. Guide groove 30 in the form of a guide portion provided on substrate 2 is provided to guide pushing pin 20 to outlet slot 6.

Figure 5A:
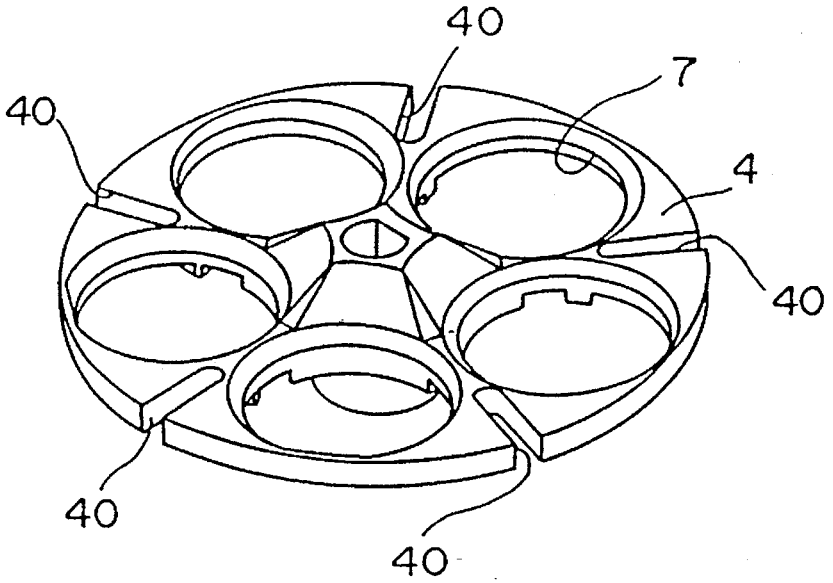
Figure 5B:
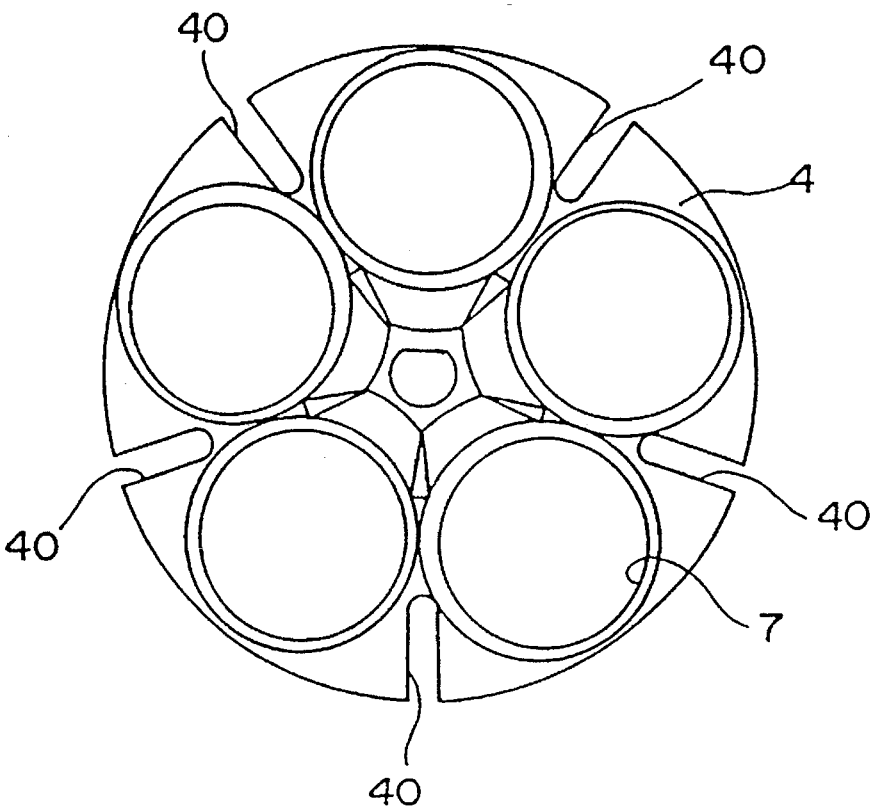
FIG. 5*b* is a plain view of the same.

As shown in FIGS. 5*a* and 5*b*, five guide apertures are arranged circumferentially in coin transporting disc 4 at equal intervals, and sliding portions 40 are each cut in an outer circumferential portion of coin transporting disc 4 between mutually adjacent guide receptacles 7. These sliding portions extend along the radial direction of coin transporting disc 4 and guide the upper end 21 of pushing pin 20 but permit it to slide freely.

Figure 2A:
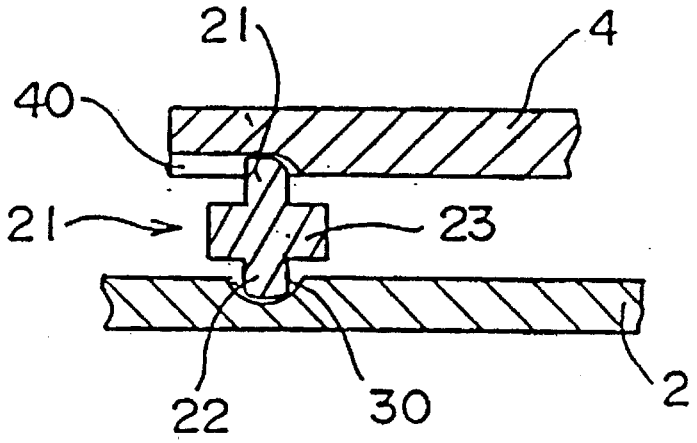
FIGS. 2*a*, 2*b* and 2*c* are partial cross-sectional views showing the mutual relationships between elements of the preferred embodiment shown in FIG. 1.
Figure 2B:
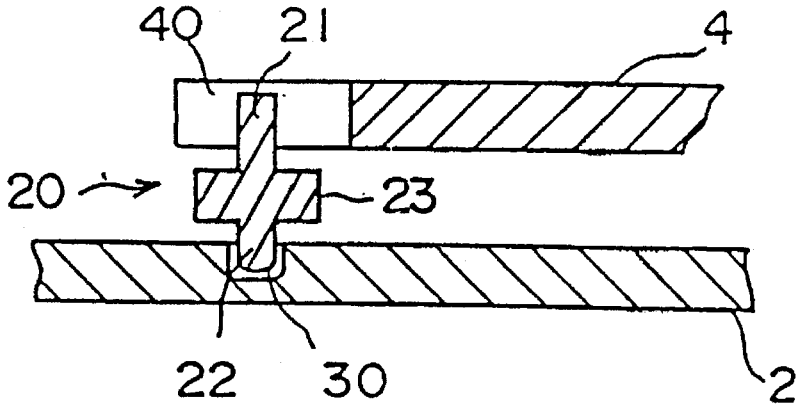

In FIG. 2*a*, this sliding portion 40 is arranged on the back side, or substrate side, of coin transporting disc 4, and is in the form of a groove having a concave shaped cross-section. In FIG. 2*b*, sliding portion 40 is in the form of a rectangular shaped slot formed in coin transporting disc 4. In addition, in FIG. 2*c*, sliding portion 40 is separately provided on the back side of coin transporting disc 4 in the form of a plate suspended on the substrate side. As a result of having this constitution, the force generated by movement of coin transporting disc 4 is transmitted to the upper end 21 of pushing pin 20, resulting in movement of pushing pin 20.

Figure 2C:
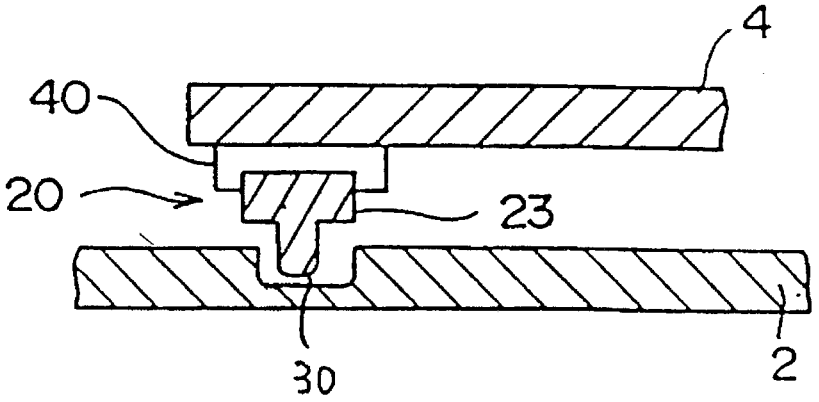

In FIGS. 2*a* and 2*b*, the upper end 21 of pushing pin 20 is arranged in a groove of sliding portion 40, while lower end 22 is arranged in guide portion 30. In addition, pushing pin 20 has rib 23 between its upper end 21 and lower end 22 that makes contact with coins. In FIG. 2*c*, pushing pin 20 does not have an upper end 21, but has a separate rib 24 on lower end 22.

Figure 3:
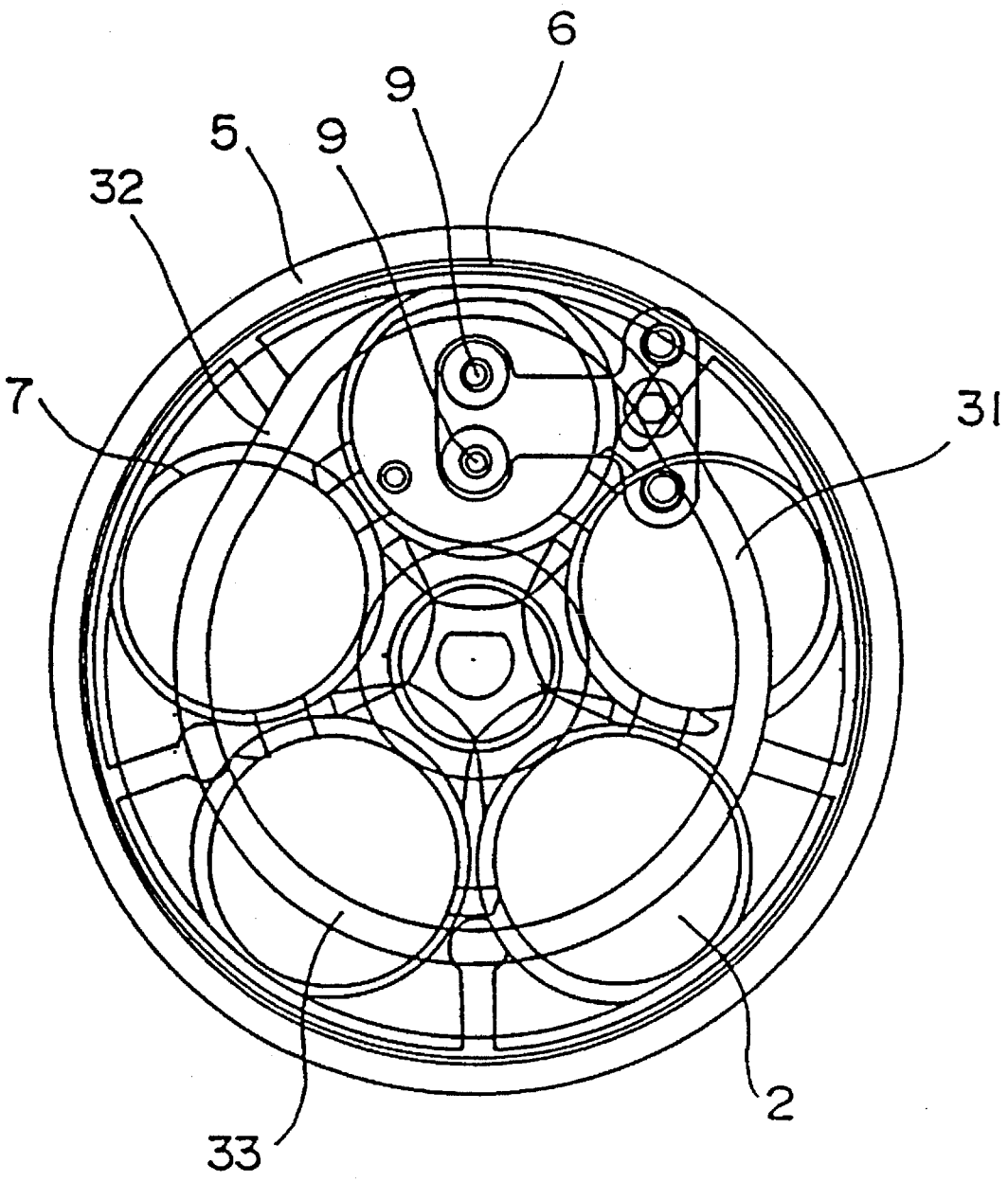
FIG. 3 is a diagrammatic plain view from the upper surface of the coin dispensing apparatus in the preferred embodiment of the present invention.

As shown in FIGS. 2*a*–2*c*, guide portion 30 is provided on substrate 2 having a concave shaped cross-section. As shown in FIG. 3, guide portion 30 follows a pushing path 31, a return path 32 continuous with pushing path 31, and an inner circumferential path 33 continuous with return path 32. Pushing path 31 extends from the terminal end of inner circumferential path 33 to outlet slot 6 on substrate 2, return path 32 extends from outlet slot 6 to the starting end of inner circumferential path 33 on substrate 2, and inner circumferential path 33 is provided concentrically with coin transporting disc 4 on the inside of a circle that passes through the centers of guide apertures 7, having the center of coin transporting disc 4 as its axis.

Figure 4:
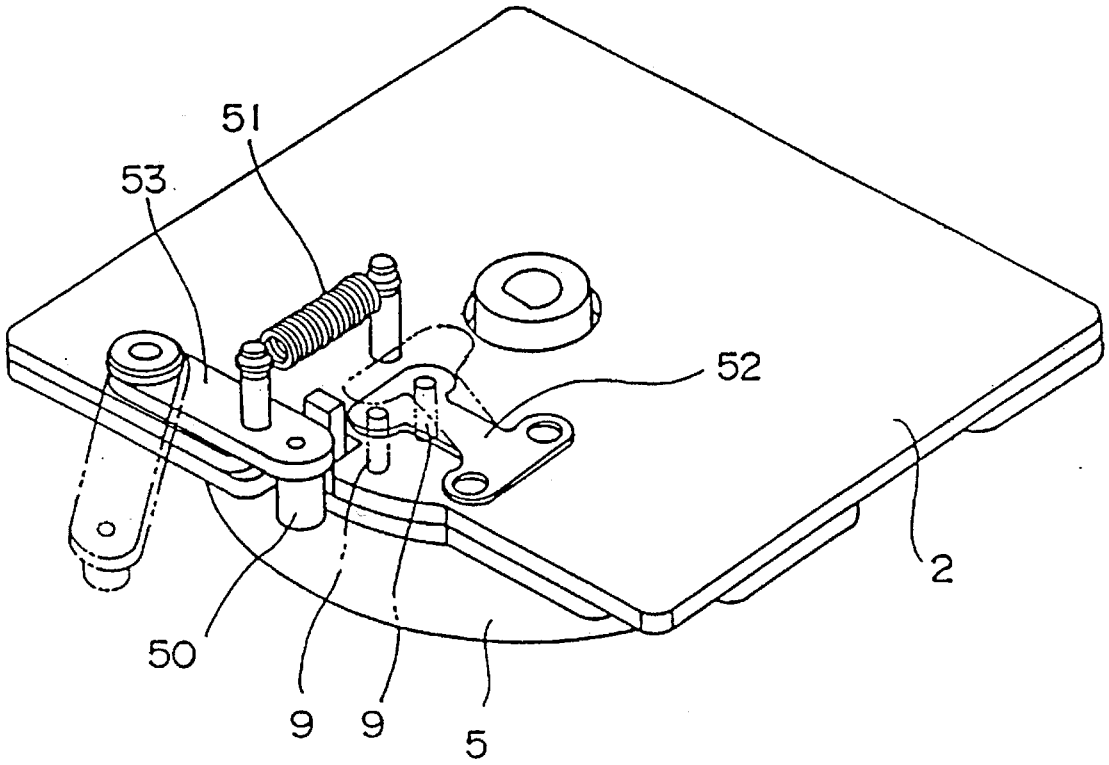
FIG. 4 is a bottom view of the lower surface of the coin dispensing apparatus in the preferred embodiment of the present invention.

Returning to FIG. 1, rotatable outlet roller 50 is provided on outlet slot 6. Outlet roller 50 dispenses coins outside by making contact with coins pushed out by pushing pin 20. As shown in FIG. 4, outlet roller 50 is arranged to be able to approach and move away from outlet slot 6 by spring 51 provided on the back of substrate 2. Furthermore, plate spring 52 shown in the drawing is for making regulating pin 9 retractable with respect to substrate 2 by bending backward and returning to its original position.

This outlet roller 50 is for preventing coins from becoming jammed. Namely, in the case the center points of roller pin 20, a coin and outlet roller 50 are all arranged on a straight line, rotation of disc 4 is obstructed as a result of these three components being in balance. In order to disrupt this balance, spring 51 is provided on roller arm 53 of outlet roller 50. Movement of the roller arm 53 allows coins that have become balanced to eject from the outlet slot 6.

Figure 6A:
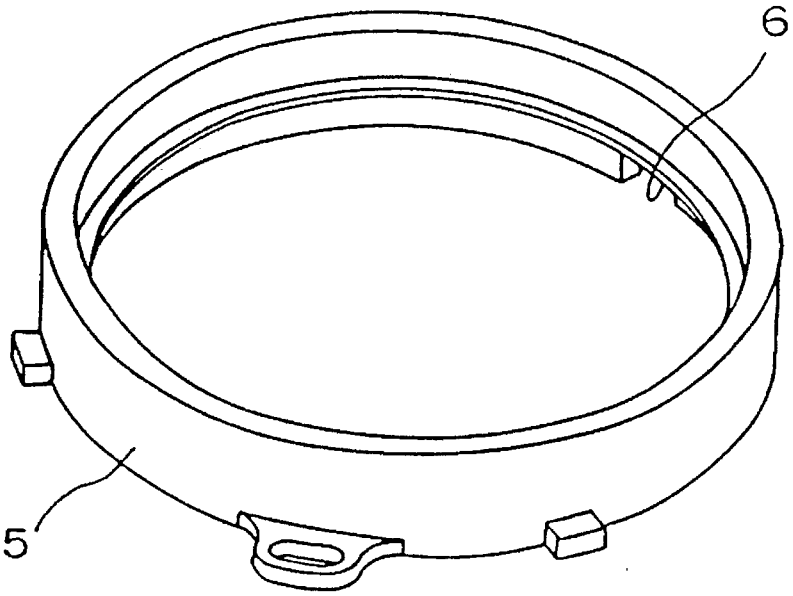
Figure 6B:
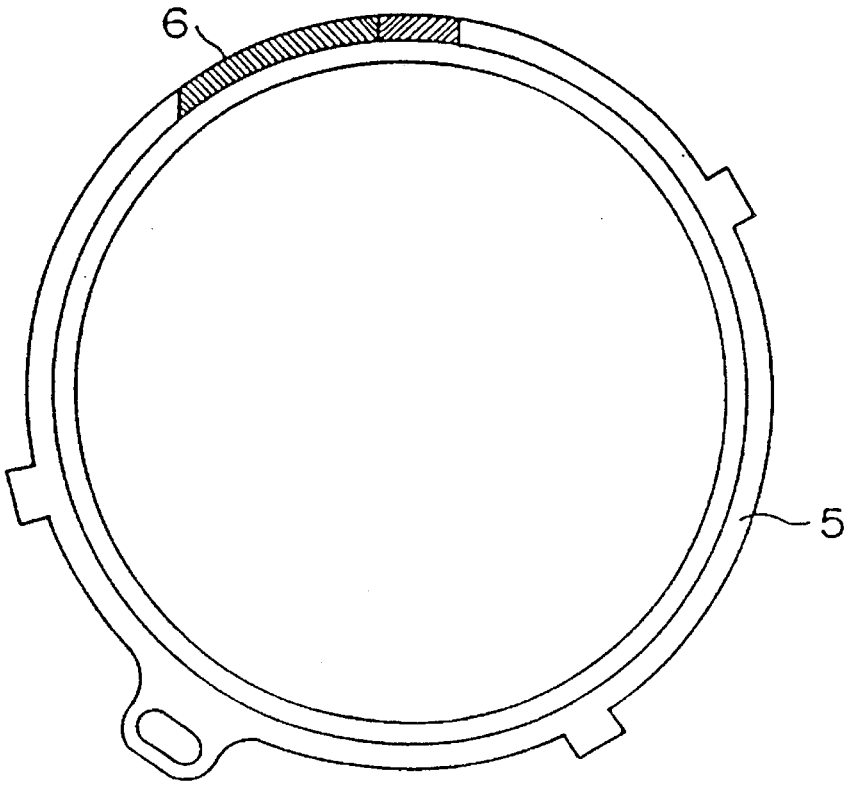
FIG. 6*b* is a plain view of the same.

Furthermore, FIGS. 6*a* and 6*b* show detailed views of outlet slot 6 formed in cylindrical case 5.

Figure 7:
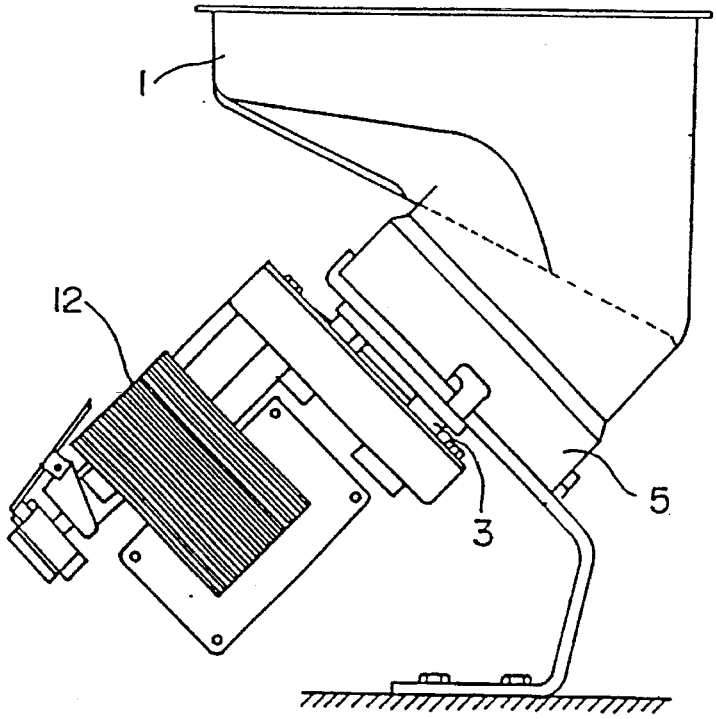
FIG. 7 PRIOR ART
FIG. 7 is a side view showing a conventional coin dispensing apparatus.
Figure 8:
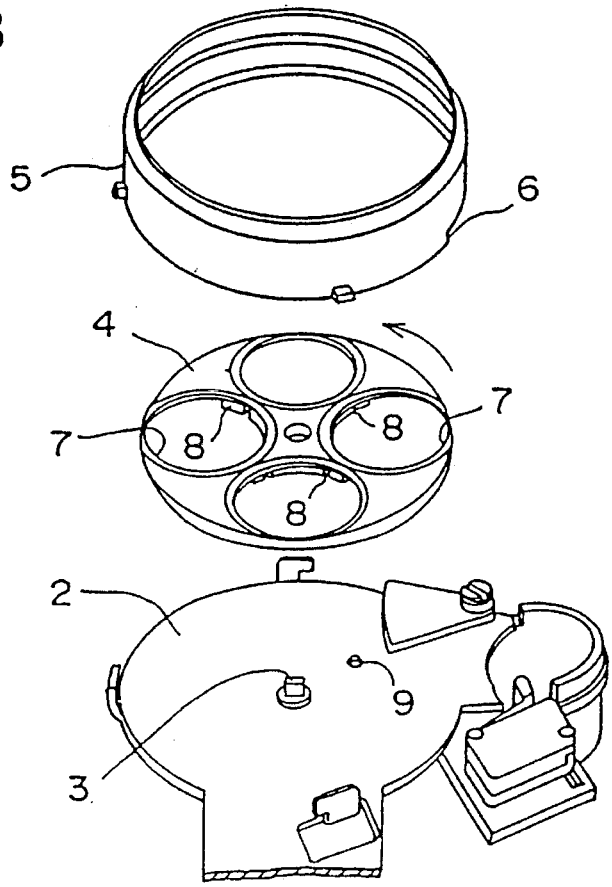
FIG. 8 PRIOR ART
FIG. 8 is an exploded perspective view of a conventional coin dispensing apparatus.
Figure 9:
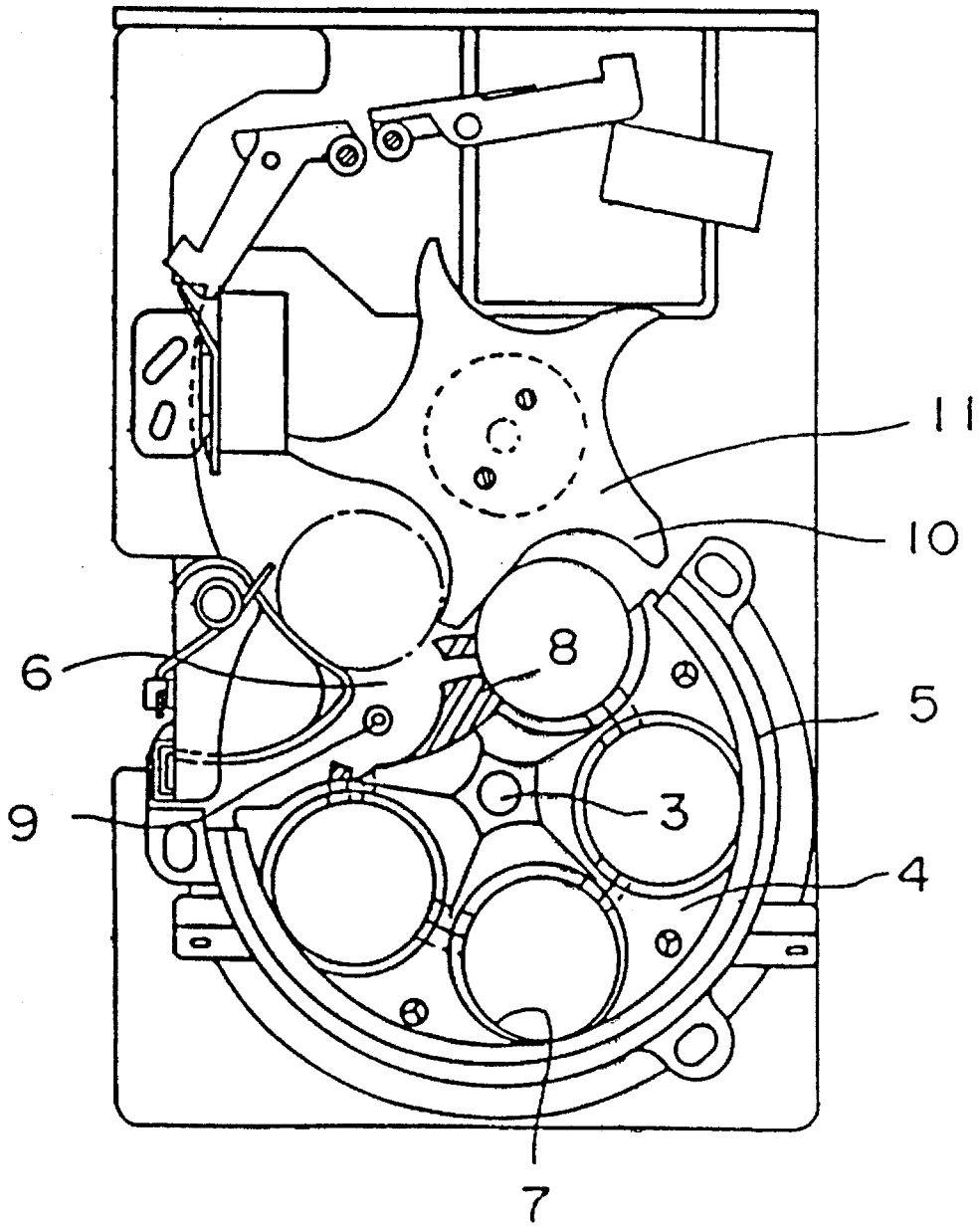
FIG. 9 PRIOR ART
FIG. 9 is a plain view, a portion of which has been cut out, of another conventional coin dispensing apparatus.

Next, the following provides an explanation of the operation of the coin dispensing apparatus claimed in the present embodiment with reference to FIG. 1. As is also shown in FIG. 7, together with coin transporting disc 4 rotating counter-clockwise by means of drive shaft 3 driven by drive motor 12, a single coin from those coins presently accumulated in hopper 1 are guided by guide aperture 7 on substrate 2. Accompanying rotation of coin transporting disc 4, pushing pin 20 moves in the counter-clockwise direction along inner circumferential path 33 (see FIG. 3) of guide portion 30 by means of sliding portion 40. Similarly, transporting arm 8, mounted on the substrate side of coin transporting disc 4, dispenses the coin in guide aperture 7 in the counter-clockwise direction while also moving in the counter-clockwise direction.

Next, when the coin dispensed by transporting arm 8 makes contact with regulating pin 9 arranged at a position facing outlet slot 6, the coin leaves the course of transporting arm 8. At this time, pushing pin 20 following this transporting arm 8 switches to pushing path 31 from inner circumferential path 33 and makes contact with the coin that has left the course of transporting arm 8.

As a result of pushing pin 20 gradually moving towards outlet slot 6 along pushing path 31, it works in concert with regulating pin 9 to press out the coin towards outlet slot 6. The coin that has been pushed out in this manner makes contact with outlet roller 50 where it is then smoothly dispensed to the outside.

Pushing pin 20 then completes one cycle of operation by switching to return path 32 and moving away from outlet slot 6 by the rotation of coin transporting disc 4.

Although the case of providing transporting arm 8 and regulating pin 9 has been explained in the present embodiment, pushing pin 20 alone can also reliably dispense one coin at a time until and including the final coin left in the apparatus without using transporting arm 8 and regulating pin 9.

Namely, since inner circumferential path 33 is provided on the inside of a circle that passes through the centers of guide apertures 7, having the center of coin transporting disc 4 as its axis, pushing pin 20 applies force in the direction in which coins are always pushed out to cylindrical case 5 along inner circumferential path 33. Coins are dispensed to outlet slot 6 while being pinched between pushing pin 20 gradually moves towards outlet slot 6 along pushing path 31, and centrifugal force is applied to the coins due to the torque of coin transporting disc 4, the coins are dispensed in the manner of being flung out at the moment they are located at outlet slot 6.

According to the present invention as explained above, since a pushing member, which pushes out coins towards an enclosure wall by rotation of a rotary disc, and a guide portion, which guides the pushing member to at least an outlet slot, are provided, coins can be dispensed one at a time until and including the last coin in the apparatus without requiring a component such as a scraper and so forth, thus allowing the providing of a coin dispensing apparatus that can satisfy the need for downsizing.

The entire disclosure of each and every foreign patent application from which the benefit of foreign priority has been claimed in the present application is incorporated herein by reference, as if fully set forth.

Although this invention has been described in at least one preferred embodiment with a certain degree of particularity, it is to be understood that the present disclosure of the preferred embodiment has been made only by way of example and that numerous changes in the details and arrangement of components may be made without departing from the spirit and scope of the invention as hereinafter claimed.

What is claimed is:

1. An apparatus for dispensing coins comprising:

a substrate having a surface;

a rotary disc rotatable with respect to said substrate;

an enclosure surrounding said rotary disc;

an outlet slot provided in said enclosure;

guide apertures formed in said rotary disc for guiding said coins on the surface of said substrate;

a pushing member positioned between said substrate and said rotary disc for pushing said coins towards said outlet slot as said rotary disc is rotated; and a guiding track disposed on at least one of said substrate and rotary disc for guiding said pushing member between at least a first position and a second position, said second position being proximate said outlet slot;

wherein said guiding track comprises a pushing path, a return path operatively connecting to said pushing path and an inner circumferential path operatively connecting to said return path, said pushing path extends from a first pre-determined position on said substrate to said outlet slot, said return path extends from said outlet slot to a pre-determined second position on said substrate, and said inner circumferential path extends from said second position to said first position and is provided concentrically to said rotary disc having the center of said rotary disc as its axis.

2. The coin dispensing apparatus as set forth in claim 1, wherein said inner circumferential path is provided on the inside of a circle that passes through the centers of said guide apertures having the center of said rotary disc as its axis, and said pushing member forces coins towards said enclosure by being guided along said inner circumferential path.

3. The coin dispensing apparatus as set forth in claim 1, wherein said inner circumferential path is provided on the outside of a circle passing through the centers of said guide apertures having the center of said rotary disc as its axis, and said pushing member has transporting arms that slide coins in the rotating direction of said rotary disc on said substrate, and pushing pins that push out coins along said inner circumferential path by forcing said coins towards said pushing member.

4. The coin dispensing apparatus set forth in claim 3, wherein said transporting arms rotate with said rotary disc, are positioned between said substrate and said rotary disc, and extend along the radial direction to a circle that passes through the centers of said guide apertures having the center of said rotary disc as its axis, and at least one end of said pushing pins is arranged in operative contact with said guide means, and at least one of said pushing pins has a rib between said one end and said other end that makes contact with said coins.

5. An apparatus for dispensing coins comprising:

a substrate having a surface;

a rotary disc rotatable with respect to said substrate;

an enclosure surrounding said rotary disc;

an outlet slot provided in said enclosure;

guide apertures formed in said rotary disc for guiding said coins on the surface of said substrate, said apertures comprising a coin transporting structure fixed on said disc;

a pushing member positioned between said substrate and said rotary disc for pushing said coins towards said outlet slot by movement of said pushing member as said rotary disc is rotated; and guide means disposed on at least one of said substrate and rotary disc for guiding said pushing member between at least a first position and a second position, said second position being proximate said outlet slot;

wherein said guide means comprises a first guiding track disposed on said rotary disc and extending substantially from an inner radial position to an outer radial position of said disc and being operative to guide one end of said pushing member;

wherein said first guiding track is arranged on the substrate-adjacent side of said rotary disc and has a concave cross-section.

6. The coin dispensing apparatus as set forth in claim 5, having a direction changing member provided on said substrate at a position facing said outlet slot, wherein said direction changing member makes contact with coins pushed out by said pushing member to change their direction so that said coins are pressed out towards said outlet slot.

7. An apparatus for dispensing coins comprising:

a substrate having a surface;

a rotary disc rotatable with respect to said substrate;

an enclosure surrounding said rotary disc;

an outlet slot provided in said enclosure;

guide apertures formed in said rotary disc for guiding said coins on the surface of said substrate, said apertures comprising a coin transporting structure fixed on said disc;

a pushing member positioned between said substrate and said rotary disc for pushing said coins towards said outlet slot by movement of said pushing member as said rotary disc is rotated; and guide means disposed on at least one of said substrate and rotary disc for guiding said pushing member between at least a first position and a second position, said second position being proximate said outlet slot;

wherein said guide means comprises a first guiding track disposed on said rotary disc and extending substantially from an inner radial position to an outer radial position of said disc and being operative to guide one end of said pushing member;

wherein said first guiding track extends through said rotary disc.

8. An apparatus for dispensing coins comprising:

a substrate having a surface;

a rotary disc rotatable with respect to said substrate;

an enclosure surrounding said rotary disc;

an outlet slot provided in said enclosure;

guide apertures formed in said rotary disc for guiding said coins on the surface of said substrate, said apertures comprising a coin transporting structure fixed on said disc;

a pushing member positioned between said substrate and said rotary disc for pushing said coins towards said outlet slot by movement of said pushing member as said rotary disc is rotated; and guide means disposed on at least one of said substrate and rotary disc for guiding said pushing member between at least a first position and a second position, said second position being proximate said outlet slot;

wherein said guide means comprises a first guiding track disposed on said rotary disc and extending substantially from an inner radial position to an outer radial position of said disc and being operative to guide one end of said pushing member;

wherein said guide means further comprises a second guiding track on said substrate, one end of said pushing member being operatively disposed with respect to said first guiding track and the other end of said pushing member being operatively disposed with respect to said second guiding track, and said pushing member makes contact with said coins between said one end and said other end.

9. An apparatus for dispensing coins comprising:

a substrate having a surface;

a rotary disc rotatable with respect to said substrate;

an enclosure surrounding said rotary disc;

an outlet slot provided in said enclosure;

guide apertures formed in said rotary disc for guiding said coins on the surface of said substrate, said apertures comprising a coin transporting structure fixed on said disc;

a pushing member positioned between said substrate and said rotary disc for pushing said coins towards said outlet slot by movement of said pushing member as said rotary disc is rotated; and guide means disposed on at least one of said substrate and rotary disc for guiding said pushing member between at least a first position and a second position, said second position being proximate said outlet slot;

wherein said guide means comprises a first guiding track disposed on said rotary disc and extending substantially from an inner radial position to an outer radial position of said disc and being operative to guide one end of said pushing member;

wherein said guide means further comprises a second guiding track on said substrate, one end of said pushing member being operatively disposed with respect to said first guiding track and the other end of said pushing member being operatively disposed with respect to said second guiding track, and said pushing member makes contact with said coins between said one end and said other end;

wherein said guide apertures have outer edges and said pushing member has a rib for contacting said coins and said rib has a diameter that extends to said outer edges of said guide apertures.

10. An apparatus for dispensing coins comprising:

a substrate having a surface;

a rotary disc rotatable with respect to said substrate;

an enclosure surrounding said rotary disc;

an outlet slot provided in said enclosure;

a plurality of guide apertures formed in said rotary disc and arranged circumferentially at equal intervals for guiding said coins on the surface of said substrate, said apertures comprising a coin transporting structure fixed on said disc;

a pushing member being disposed between two mutually adjacent guide apertures and positioned between said substrate and said rotary disc for pushing said coins towards said outlet slot by movement of said pushing member as said rotary disc is rotated; and guide means disposed on at least one of said substrate and rotary disc for guiding said pushing member between at least a first position and a second position, said second position being proximate said outlet slot.

11. An apparatus for dispensing coins comprising:

a substrate having a surface;

a rotary disc rotatable with respect to said substrate;

an enclosure surrounding said rotary disc;

an outlet slot provided in said enclosure;

a plurality of guide apertures/formed in said rotary disc and arranged circumferentially at equal intervals for guiding said coins on the surface of said substrate;

a pushing member being disposed between mutually adjacent guide apertures and positioned between said substrate and said rotary disc for pushing said coins towards said outlet slot as said rotary disc is rotated; and a guiding track disposed on at least one of said substrate and rotary disc for guiding said pushing member between at least a first position and a second position, said second position being proximate said outlet slot;

wherein said guiding track comprises a pushing path, a return path operatively connecting to said pushing path and an inner circumferential path operatively connecting to said return path, said pushing path extends from a first pre-determined position on said substrate to said outlet slot, said return path extends from said outlet slot to a pre-determined second position on said substrate, and said inner circumferential path extends from said second position to said first position and is provided concentrically to said rotary disc having the center of said rotary disc as its axis.

12. An apparatus for dispensing coins having at least a specified thickness comprising:

a substrate having a surface;

an enclosure fixed to said substrate surface;

a moveable conveying member disposed within said enclosure and comprising a plurality of coin guides arranged circumferentially and at equal intervals and being moveable with respect to said substrate for conveying coins along a predetermined path on said substrate surface;

a coin outlet disposed in said enclosure along said path;

a plurality of pushing members, each disposed between mutually adjacent coin guides positioned between said substrate and said moveable member for pushing said conveyed coins within a corresponding one of said coin guides towards said outlet in correspondence with movement of said moveable member; and guide means disposed on at least one of said substrate and moveable member for guiding said pushing members between at least a first position and a second position where said coin is ejected from said coin outlet.

13. An apparatus for dispensing coins comprising:

a substrate having a surface;

a rotary disc rotatable with respect to said substrate;

an enclosure surrounding said rotary disc;

an outlet slot provided in said enclosure;

guide apertures formed in said rotary disc and arranged circumferentially thereon for guiding said coins on the surface of said substrate;

a plurality of pushing members being disposed between mutually adjacent guide apertures and positioned between said substrate and said rotary disc for pushing said coins towards said outlet slot as said rotary disc is rotated; and guide means disposed on at least one of said substrate and rotary disc for guiding said pushing members between at least a first position and a second position, said second position being proximate said outlet slot, wherein said guide means comprises a plurality of first guiding tracks disposed at least on the substrate-adjacent side of said rotary disc, each first guiding track extending substantially from an inner radial position to an outer radial position of said disc and being operative to guide one end of a corresponding one of said pushing members.

* * * * *